United States Patent [19]

Kawachi et al.

[11] Patent Number: 4,997,386

[45] Date of Patent: Mar. 5, 1991

[54] CONNECTORS

[75] Inventors: Kazuhiro Kawachi; Kunihiko Muraoka, both of Tokyo, Japan

[73] Assignees: Japan Aviation Electronics Industry Ltd.; Fuji Heavy Industries, Ltd., both of Tokyo, Japan

[21] Appl. No.: 486,896

[22] Filed: Feb. 28, 1990

[30] Foreign Application Priority Data

Mar. 1, 1989 [JP] Japan ..... 1-46640

[51] Int. Cl.[5] ..... H01R 13/627

[52] U.S. Cl. ..... 439/352; 439/355; 439/540; 439/701

[58] Field of Search ..... 439/540, 695, 701, 717, 439/715, 594, 599, 733, 752, 596, 372, 352-355

[56] References Cited

U.S. PATENT DOCUMENTS 4,017,141 4/1977 Bury et al. ..... 439/596

4,674,814 6/1987 Hoshino et al. ..... 439/372

*Primary Examiner*—David L. Pirlot
*Assistant Examiner*—Julie R. Daulton
*Attorney, Agent, or Firm*—Bierman and Muserlian

[57] ABSTRACT

An electrical connector including a pin contact housing having a plurality of recesses and socket contact housings to be received in the corresponding recesses. The socket contact housing is provided with a resilient finger with an opening which can be engaged with a ridge projected from the inner wall of each of recesses. The pin contact housing is provided with a lock bar having first latch members which can be lowered down and engaged with the corresponding second latch members arranged to the socket contact housing when the socket contact housing is completely received in the recess in the pin contact housing to prevent separation of the pin contact housing and the socket contact housing.

3 Claims, 3 Drawing Sheets

CONNECTORS

BACKGROUND OF THE INVENTION

1. Field of the Invention:

This invention relates to an electrical connector including a socket contact housing and a pin contact housing and more particularly to an electrical connector having locking arrangements for maintaining the socket contact housing in coupled relationship with the pin contact housing.

2. Description of the Prior Art:

In the case where a pin contact housing and a socket contact housing are assembled or coupled to each other, it is preferable that both housings are not separated in packing or transporting, even though external force is applied to them.

Usually, in order to prevent the separation of the pin contact housing from the socket contact housing connected with each other, the connector is provided with a single locking device which includes a first locking member arranged to the pin contact housing and a second lock member arranged to the socket contact housing, both of which are adapted to engage with each other when the pin contact housing is completely received in the socket contact housing. The confirmation of the engagement between the first and second locking members is ordinary depended upon the operator's experience.

Japanese Patent Non-examined Publication No. 60-207270 published on Oct. 18, 1985 discloses a connector having a first lock means and a second lock means. According to the above publication, one of the housings is provided with a resilient and movable projecting member in transverse to the direction of inserting the socket contact housing into the pin contact housing, the other housing is provided with a portion for engaging with the above resilient member when the socket contact housing is received in the pin contact housing, and the pin contact housing is provided on the upper surface thereof with a hinged lock member which can be engaged with the socket contact housing received in the pin contact housing.

In the connector disclosed in the above publication, however, there are several disadvantages in making the hinged lock member and in the physical dimension of the housing.

SUMMARY OF THE INVENTION

In the light of the foregoing, it is a principal object of the present invention to provide an improved electrical connector having locking arrangements for maintaining a pin contact housing in coupled or assembled relationship with a socket contact housing by means of a plurality of locking arrangements.

It is a further object of the present invention to provide an electrical connector having locking arrangements by which the pin contact housing and the socket contact housing can be mechanically locked together against accidental separation.

These and other objects of the present invention are achieved in a preferred embodiment thereof which is described in detail below taken in conjunction with the accompanying drawings.

DESCRIPTION OF THE PREFERRED EMBODIMENT

Figure 1:
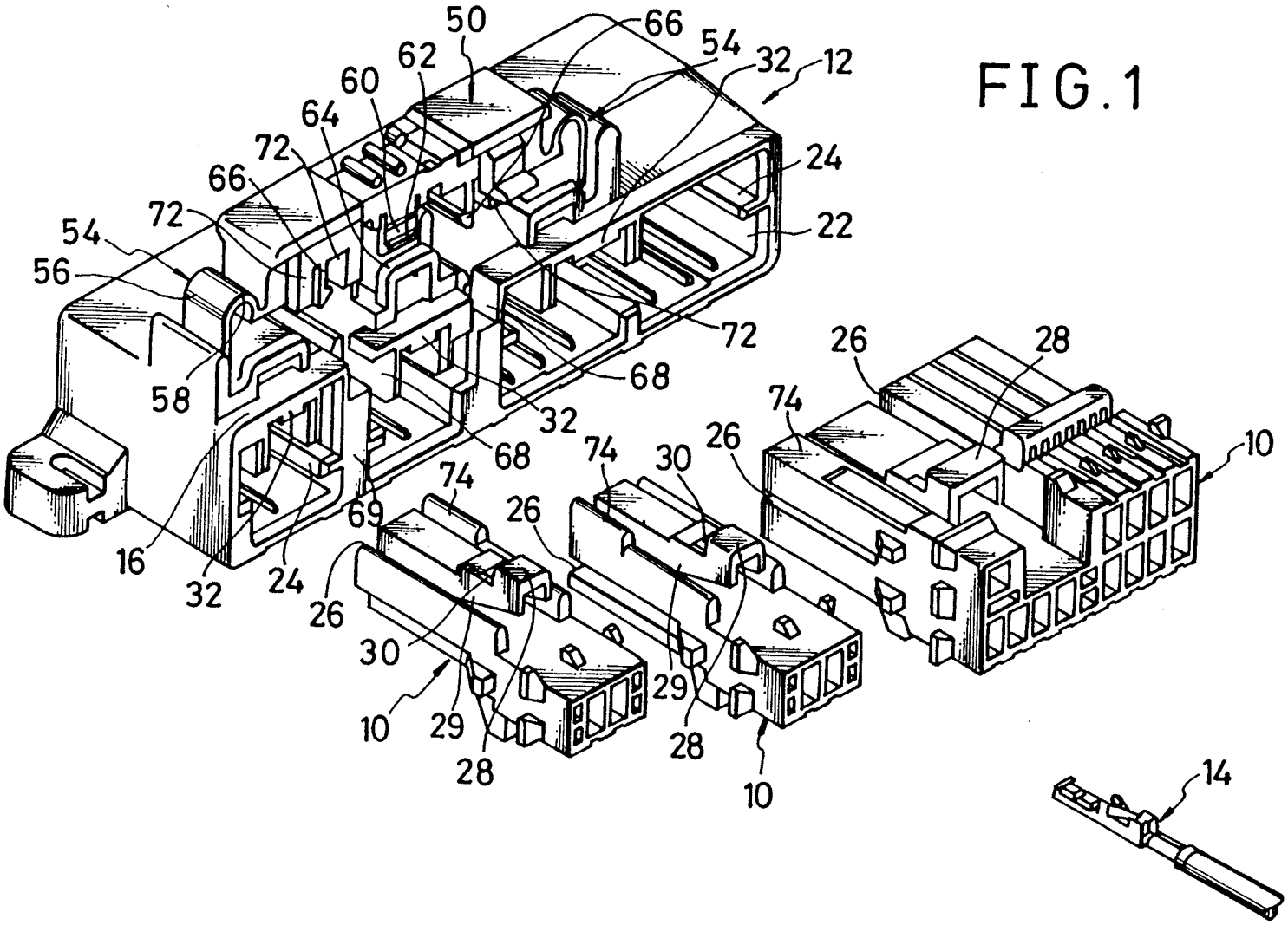
FIG. 1 is an exploded perspective view of a connector having first and second locking arrangements in accordance with and embodying the present invention.

Referring now to FIG. 1 of the drawings, the electrical connector according to the present invention is shown as including a plurality of socket contact housings 10, and a pin contact housing 12 which is adapted to assembled with the socket contact housings 10 each of which a plurality of socket contact elements 14 are mounted on.

Each of the socket contact housings 10 is inserted or received in spaced apart parallel recesses 22 in the pin contact housing 12. In order to insert the socket contact housing 10 into the recess 22 correctly, the inner side wall of the chamber 22 is provided with a rib 24, and the socket contact housing 10 is provided with a slot 26 in which the rib 24 is received and guided.

As a first member for locking the socket contact housing 10 to the pin contact housing 12, the socket contact housing 10 is integrally provided at the top wall thereof with a resilient finger 28 that is adapted to flex about a hinge connection 29. Adjacent to the finger 28 there is provided an opening 30.

In the inner surface of the top wall of each of the recess 22, there is a ridge 32 which can be received in the opening 30 in each of the socket contact housing 10 when the socket contact housing 10 is received in the pin contact housing 12, and then the resilient finger 28 can be lowered by the operator.

As the result of the engagement of the above opening 30 with the ridge 32, the socket contact housing 10 can be connected with and secured to the pin contact housing 12 completely. That is, the opening 30 and the ridge 32 serve to as a first lock arrangement. However, in some instances it has been found that the socket contact housing 10 is insufficiently received in the pin contact housing 12 or the ridge 32 is removed from the opening 30.

According to the present invention, to remove the above defects, at the upper surface of the top wall 16 of the pin contact housing 12, there is provided a second locking member 50 including a lock bar 52 and a pair of band members 54. The lock bar 52 is extended parallel to the front edge of the pin contact housing 12 and both ends of the lock bar 52 are fixedly secured to the upper surface of the pin contact housing 12 by the corresponding band portions 54.

Figure 2:
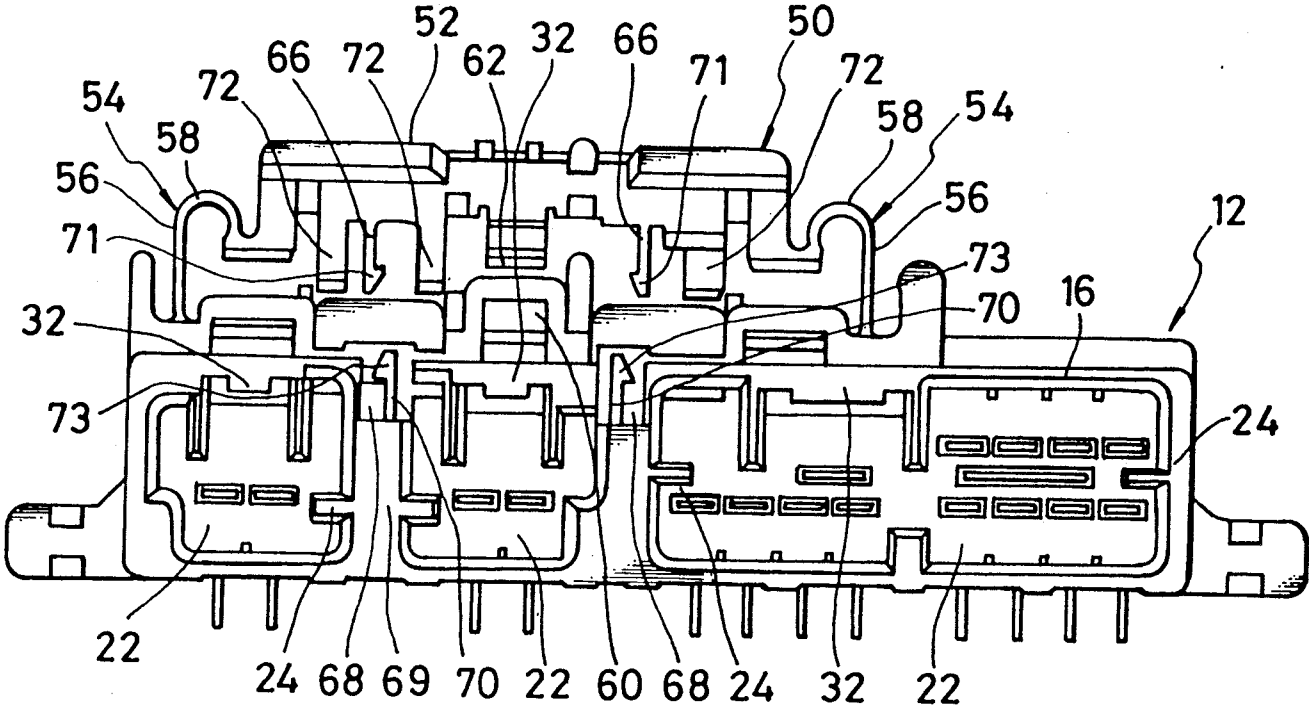
FIG. 2 is a front elevational view of a socket contact housing showing the condition that the second locking arrangement has not been operated.
Figure 3:
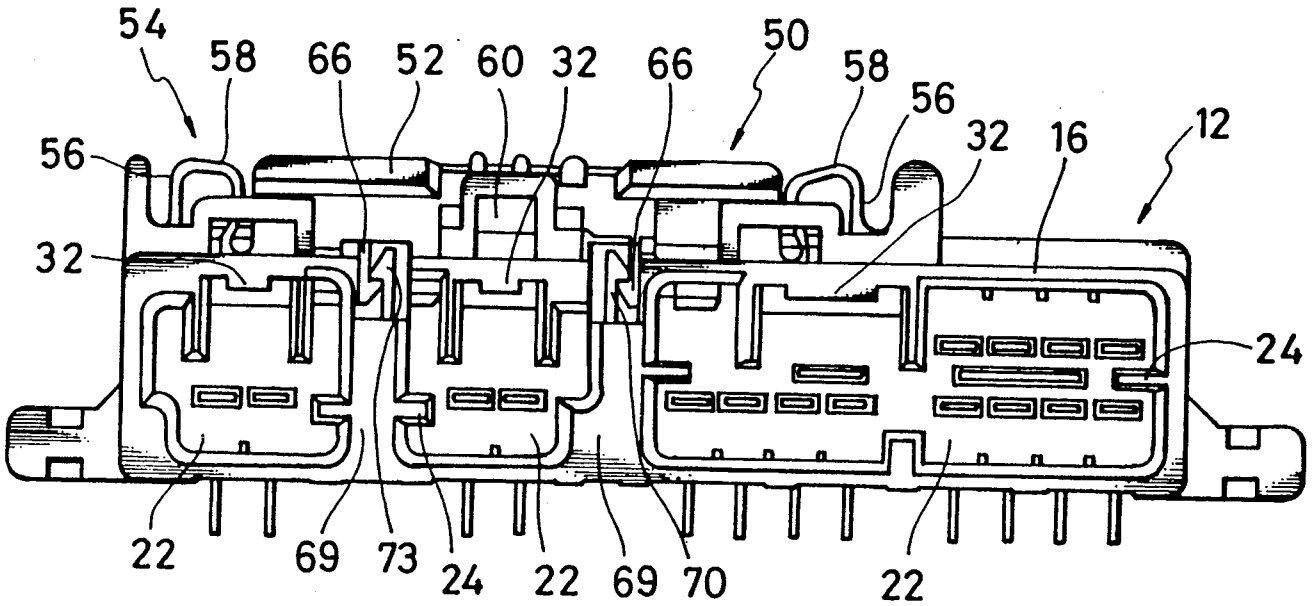
FIG. 3 is a front elevational view similar to FIG. 2 showing the condition that the second locking arrangement has been operated.

The band portion 54 includes an upright post portion 56 and a curved portion 58. As shown in FIG. 2, before locking the socket contact housing 10 to the pin contact housing 12 by means of the second lock member 50, the lock bar 52 is spaced apart from the upper surface of the top wall 16 of the pin contact housing 12.

At the central portion of the lock bar 52, there is provided a projecting member 60 which is extended downwardly from the underside of the lock bar 52, the lower side of the projecting member 60 is formed with a raised edge 62. When the lock bar 52 is lowered down by the operator, the raised edge 62 of the projecting member 60 is engaged with the top bar portion of a reversed U-shaped member 64 secured to the top wall of the pin contact housing 12 by its leg portions. The hollow space formed between the leg portions of the revised U-shaped member 64 serves to guide the lock bar 52.

The lock bar 52 is provided with a pair of first latch members 66 which are respectively spaced apart from each side of the projecting member 60 and extended downwardly from the underside of the raised edge 62 to a position which is lower than the raised edge 62. When the lock bar 52 is lowered to its lowest position, the first latch member 66 is maintained to its lower position. To this end, the top wall 16 of the pin contact housing 12 is provided with an opening 68 so that the first latch member 66 may be moved therein when the lock bar 52 is depressed. The base portion 69 of the pin contact housing 12 is provided with a pair of second latch members 70 at the adjacent to the first latch members 66. The lower end of each of the first latch members 66 and the upper end of each of the second latch members 70 are respectively formed with a gradually thickened triangular edge 71 or 73. When the lock bar 52 is depressed, these edges 71 and 73 can be engaged with each other.

The lock bar 52 is provided with a pair of third latch members 72 which can be engaged with the corresponding fourth latch members 74 provided to the socket contact housing 10 in order to prevent the socket contact housing 10 and the pin contact housing 12 from separation. For example, as shown in FIG. 1, the third latch member 72 is in the form of a post or projection and fourth latch member 74 is in the form of a stepped protrusion having an opening therein.

As clear from the foregoing, the socket contact housing 10 is inserted into the recess 22 in the pin contact housing 12 and then the resilient finger 28 is depressed by the operator's hand to retain the socket contact housing 10 in the recess 22. When the opening 30 in the resilient finger 28 is engaged with the ridge 32 of the upper wall of the recess 22 in the pin contact housing 12, the socket contact housing 10 can be locked to the pin contact housing 12, completely.

It is, however, a possibility that the socket contact housing 10 is accidentally removed from the pin contact housing 12 when external force is applied to the resilient finger 28. In addition to the above, there is the possibility that the ridge 32 cannot be received in the opening 30 completely.

According to the present invention, in the light of the above possibility, when the lock bar 52 of the pin contact housing 12 is depressed manually, and the socket contact housing 10 cannot be received completely in the pin contact housing 12, the first latch member 66 and the second latch member 70 or the third latch member 72 and the fourth latch member 74 cannot be engaged with each other, and these conditions can be observed from the outside.

On the other hand, when the socket contact housing 10 is received in the pin contact housing completely, it is possible to lower down or depress the lock bar 52 and the engagement of the latch members with each other can be sensed and observed by the operator.

Even though external force is applied to the resilient finger 28 of the socket contact housing 10 after the lock bar 52 has been depressed completely, the socket contact housing 10 will not be withdrawn from the pin contact housing 12. Further, when external force is applied to the second lock member 50, the engagement of the first latch member 66 with the second latch member 70 will not be affected thereby.

Other modifications and embodiments of the present invention are to be embodied in the scope of the appended claims.

What is claimed is:

1. An electrical connector comprising:

a plurality of socket contact housings, a pin contact housing having a plurality of recesses to receive each of the contact housings therein;

a resilient finger with an opening, which finger being integrally connected to a top wall of each of the socket contact housings so as to flex about a hinge connection;

a ridge projected from an inner surface of the top wall of each of the recesses in the pin contact housing for engaging with the opening in the resilient finger when the socket contact housing is completely received in the recess in the pin contact;

a locking member including a lock bar having a pair of first latch members, said lock bar of the locking member being mounted on the top wall of the pin contact housing by a pair of supporting bands including a pair of upright post portions fixedly secured to the pin contact housing and a pair of curved portions connected to each of the upright post portions so as to support the lock bar connected between the supporting bands without contacting with the top wall of the pin contact housing and can be lowered down when all of the socket contact housings are completely received in the recesses in the pin contact housing;

a pair of second latch members mounted on the base of the pin contact housing for engaging with the corresponding first latch members when the locking member is depressed;

a pair of third members provided on the locking member; and a pair of fourth latch members provided integrally to the socket contact housing for engaging with the corresponding third latch members when all of the socket contact housings are received in the recesses in the pin contact housing.

2. The electrical connector as claimed in claim 1 in which a pair of the first latch members are extended downwardly from the lock bar.

3. The electrical connector as claimed in claim 1 in which the first latch members and the second latch members are respectively provided with a terminal flange.

* * * * *